United States Patent [19]

Rossberg

[11] 4,365,911

[45] Dec. 28, 1982

[54] SURFACE DRAINAGE CULVERT

[75] Inventor: Shelton R. Rossberg, Houston, Tex.

[73] Assignee: Ramco Steel, Inc., Houston, Tex.

[21] Appl. No.: 284,065

[22] Filed: Jul. 16, 1981

Related U.S. Application Data

[63] Continuation-in-part of Ser. No. 168,309, Jul. 10, 1980.

[51] Int. Cl.[3] ..... E02B 11/00; E01F 5/00

[52] U.S. Cl. ..... 405/43; 404/2

[58] Field of Search ..... 405/43, 48, 49, 118, 405/124, 126; 404/2, 4

[56] References Cited

U.S. PATENT DOCUMENTS

| | | | |
|---|---|---|---|
| 3,714,786 | 2/1973 | Evans et al. | 405/49 |
| 3,876,322 | 4/1975 | Deason | 404/2 |
| 4,163,619 | 8/1979 | Fales | 405/49 |

FOREIGN PATENT DOCUMENTS

| | | | |
|---|---|---|---|
| 662530 | 12/1951 | United Kingdom | 404/4 |
| 1184664 | 3/1970 | United Kingdom | 405/43 |

*Primary Examiner*—James A. Leppink
*Assistant Examiner*—Nancy J. Pistel
*Attorney, Agent, or Firm*—Lee, Smith & Jager

[57] ABSTRACT

A surface drainage culvert of the type comprising a pipe section which is cut longitudinally forming an aperture along the upper surface of the pipe and which has an upstanding grate assembly lodged within the aperture.The aperture consists of a series of longitudinally spaced slots in the pipe with unslotted pipe portions separating each slot. The grate assembly consists of a pair of spaced, parallel sidewalls which form an inlet drainage passage to accept drainage water inflow at the top of the passage and discharge the water at the bottom of the passage through the aperture into the pipe. Lateral stiffeners maintain the spacing of the top of the drainage passage, while a spacer means, situated within a guide formed in the grate assembly sidewalls, maintains the spacing of the sidewalls at the bottom of the drainage passage. In one form of the invention, the stiffeners are an integral part of the grate between the sidewalls, while in another form of the invention, the stiffeners are an integral part of a top plate which is attached to the sidewalls. The drainage culvert is constructed by slotting of the pipe, fabricating the grate assembly, inserting the grate within the slots in the pipe, and then inserting the spacer means in the grate assembly to maintain the spacing of the sidewalls and lock the grate assembly within the pipe.

24 Claims, 10 Drawing Figures

SURFACE DRAINAGE CULVERT

RELATED APPLICATION

This application is a continuation-in-part of my pending U.S. Patant application Ser. No. 168,309, filed July 10, 1980.

BACKGROUND OF THE INVENTION

This invention pertains to drainage culvert and in particular to surface drainage culvert of the type which accommodates sheet flow of surface drainage water like that commonly encountered on paved surfaces, such as highways and parking lots.

Drainage culvert of the general nature of the subject invention have been employed to intercept sheet flow drainage water for many years. Exemplary of the prior art is U.S. Pat. No. 3,714,786 which discloses a slotted drainage culvert comprised of a longitudinal grating which is lodged within a slot formed in a metal pipe. The grating is welded to the metal pipe, and includes a pair of upstanding bearing members which are separated by spacer means generally at the neutral axis of the pipe. Other forms of earlier prior art are also disclosed and discussed in this patent.

U.S. Pat. No. 3,714,786, while claiming to be an improvement over prior art drainage culvert, suffers deficiencies of its own. First, the disclosed grating, which is inserted within the slot in the pipe, must be specially fabricated to include the spacers which are welded serially along the length of the grating. Since such a grating is typically twenty feet in length and the spacers are placed at six inch intervals, a significant fabrication effort must be undertaken for each length of grating. Secondly, the grating is inserted within the slot and welded to the pipe periodically with fillet welds. If the welds are not strong enough or if a large load is placed directly upon the grate, it is possible that the grating can be separated from the pipe in use, necessitating its removal and replacement. There is no support for the grating other than the periodic fillet welds to the pipe. Another, and consequential, disadvantage of the drainage culvert of this patent is the cost. Since the grating must be individually fabricated, and then each grating fillet welded to the slotted culvert, a substantial amount of costly labor is required to fabricate each section of drainage culvert, or costly fabrication machinery must be employed.

SUMMARY OF THE INVENTION

These disadvantages of the prior art and others are overcome by the present invention which provides a surface drainage culvert which has the advantages of the prior art but which, due to its unique construction, is substantially less expensive to fabricate.

Similar to the prior art, the drainage culvert comprises a pipe section which is cut longitudinally, thus forming an aperture along its upper surface and which has an upstanding, longitudinal grate assembly received within the aperture.

The improvements comprise the aperture of the invention, which consists of a plurality of longitudinal slots in the pipe with unslotted pipe portions separating each slot, and the unique grate assembly, which consists of a pair of spaced, parallel sidewalls extending outwardly from the pipe above the aperture, the sidewalls forming therebetween an inlet drainage passage which accepts drainage water flow at the top of the passage and discharges drainage water through the aperture into the pipe section at the bottom of the passage. Stiffener means are included at the top of the drainage passage extending between the sidewalls to maintain the spacing of the sidewalls at the top of the drainage passage. A longitudinal guide is formed in each of the sidewalls in proximity to the bottom of the drainage passage and spacer means is situated in the guide to maintain the spacing of the sidewalls at the bottom of the drainage passage.

If the drainage culvert employed is that having a helical seam, the slots can be spaced such that the seam remains inviolate along the length of the pipe section. Thus, the seam extends across the aperture at the unslotted pipe portions.

The stiffener means, in one embodiment of the invention, comprises a plurality of spaced bridges extending laterally between the sidewalls at the top of the drainage passage. Preferably, the bridges comprise integral extensions of the sidewalls and are formed during the fabrication process for the grate assembly. In another embodiment of the invention, the stiffener means comprises a plurality of spaced bridges in a top plate which is separately attached to the top edges of the sidewalls.

The longitudinal guide in each of the sidewalls comprises a channel, each of the channels being oppositely situated in the grate assembly and extending outwardly from the drainage passage. In combination with the channels, the drainage culvert may include a flange on each sidewall at the bottom of the drainage passage which extends outwardly from the drainage passage, defining a receptacle between the channel and flange in each sidewall for receipt of the pipe section along the pipe aperture and, in combination with the spacer means, comprising a means to lock the grate assembly within the pipe aperture.

In a first embodiment of the invention, the spacer means comprises at least one elongate bearing member having a series of spaced apertures for through-passage of drainage water. The apertures are spaced in registration with the inlet at the top of the grate assembly so that there is less opportunity for debris which might enter the culvert to become lodged in the grate assembly. Thus, the hydraulic efficiency of the slotted drainage culvert is not compromised.

In a second embodiment of the invention, the spacer means comprises a series of separate plates which are spaced periodically in the longitudinal guide. The locations of the plates are such that spacing of the sidewalls remains constant but the plates themselves do not interfere significantly with flow through the drainage passage.

To strengthen the grate assembly, each sidewall may include longitudinal ribs or corrugations extending inwardly or outwardly from the drainage passage along the length of the grate assembly. One or more such ribs, depending on the height of the sidewalls, can be employed.

The surface drainage culvert is constructed by forming the aperture in the pipe by cutting a series of longitudinally spaced slots in the pipe with unslotted pipe portions separating each slot. The grate assembly is fabricated to include a pair of spaced, parallel sidewalls having a longitudinal guide adjacent the bottom of the drainage passage. The grate assembly is then inserted within the slotted aperture with the longitudinal guide contiguous to the outer surface of the pipe. The spacer means is then installed within the guide to maintain the spacing of the sidewalls at the pipe aperture and to lock the grate assembly within the aperture. If a separate top plate is employed, it is lastly attached to the top edges of the sidewalls.

BRIEF DESCRIPTION OF THE DRAWINGS

The invention is described in greater detail below in connection with the drawings, in which.

DESCRIPTION OF THE PREFERRED EMBODIMENTS

Figures 1, 2, 3:
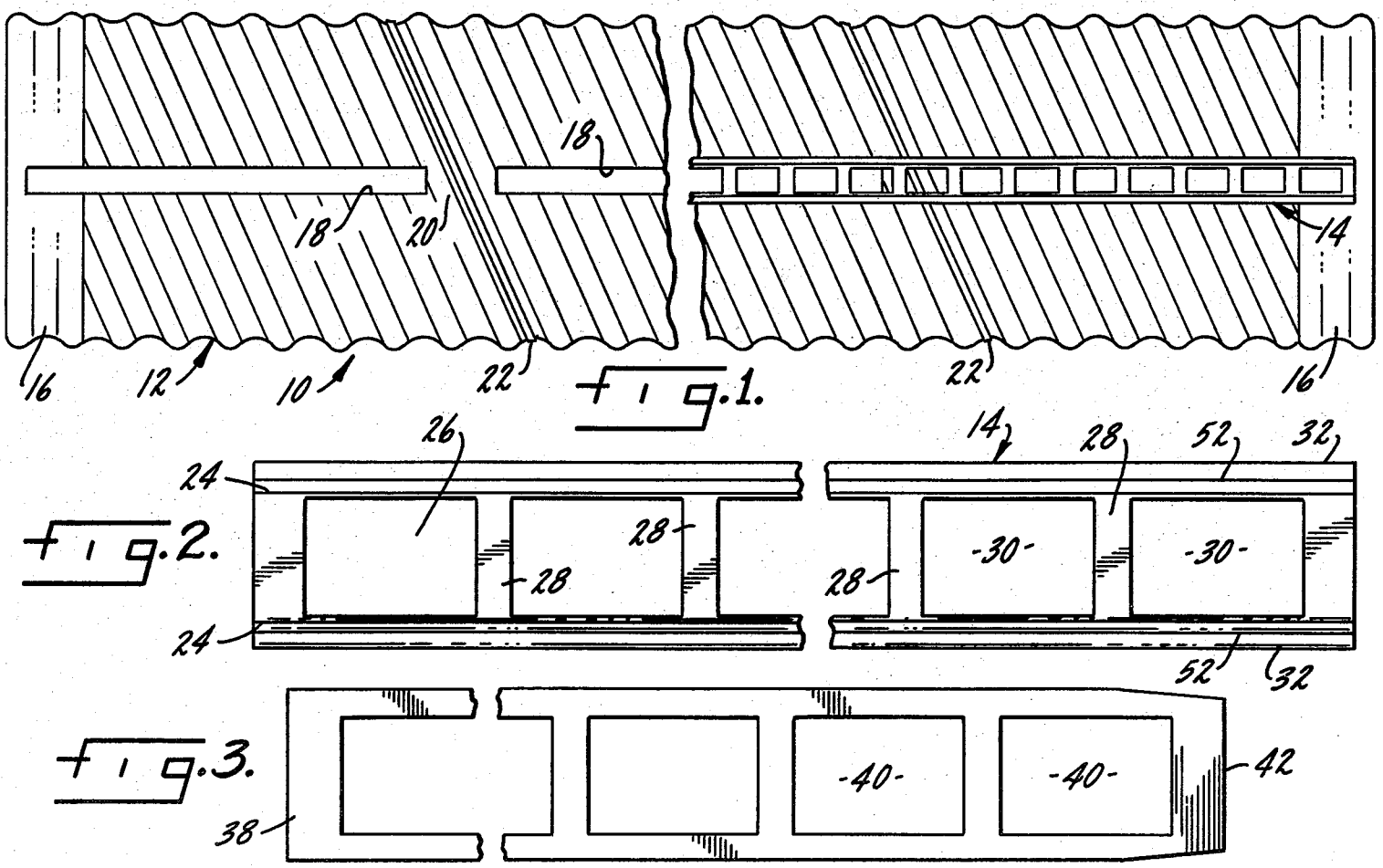
FIG. 1 is a partial top plan illustration of one embodiment a surface drainage culvert according to the invention, with portions removed for clarity and ease of description.
FIG. 2 is an enlarged top plan illustration of a grate assembly of the surface drainage culvert of FIG. 1.
FIG. 3 is an enlarged partial top plan illustration of a spacer means used to maintain the spacing of the sidewalls of the grate assembly at the bottom of the drainage passage.

One embodiment of a surface drainage culvert of the invention is depicted generally at 10 in FIG. 1. The culvert is composed of a pipe section 12 and an upstanding, longitudinal grate assembly 14 received within a longitudinally cut aperture in the upper surface of the pipe section 12.

While, as obvious to one skilled in the art, other types of pipe may be utilized, the pipe section 12 illustrated in FIG. 1 is helically fabricated. Opposite ends 16 of the pipe section 12 are shown as "recorrugated" in an annular fashion to accommodate couplers (not illustrated) for joining of two such pipe sections.

The aperture within the pipe section 12 is comprised of a series of spaced, longitudinal slots 18 in the pipe with unslotted pipe portions 20 separating each such slot 18. If the pipe section 12 is of the helical type having a helical lock seam 22 as illustrated in FIG. 1, the slots can be situated such that the lock seam 22 remains inviolate and crosses the pipe aperture at the unslotted portions 20.

The grate assembly 14 is comprised of a pair of spaced, parallel sidewalls 24 extending outwardly from the pipe above the slots 18. The spacing between the sidewalls 24 forms an inlet drainage passage 26 which accepts drainage water inflow at the top of the passage and discharges drainage water through the slots 18 into the pipe section 12 at the bottom of the passage 26.

A series of stiffeners 28 extend between the sidewalls 24 to maintain the spacing of the sidewalls at the top of the drainage passage 26. Preferably, the stiffeners 28 comprise integral, spaced bridges extending laterally between the sidewalls 24, thus defining a series of inlet apertures 30 at the top of the grate assembly 14.

A longitudinal guide 32 is formed in each of the sidewalls 24 in proximity to the bottom of the drainage passage 26. As best illustrated in FIG. 4, each guide 32 comprises a channel in each of the sidewalls 24, the channels being oppositely situate in the grate assembly and extending outwardly from the drainage passage 26, as illustrated.

Figure 4:
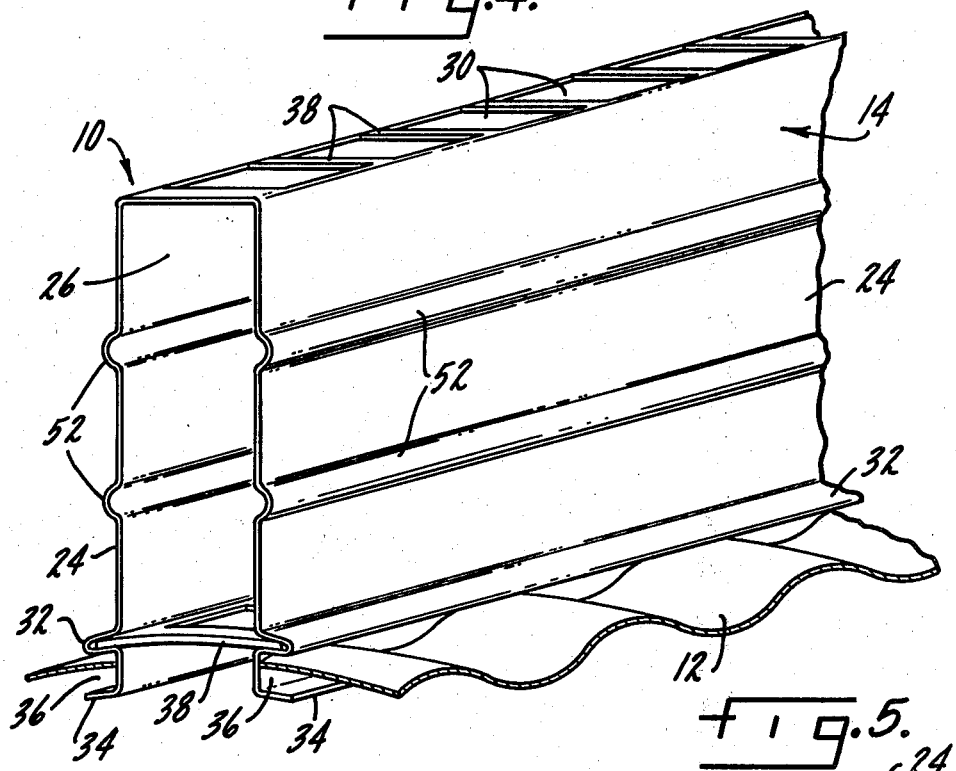
FIG. 4 is an enlarged, partial perspective illustration of a surface drainage culvert according to the invention.

Each of the sidewalls 24 includes a flange 34 at the bottom of the drainage passage 26, as illustrated in FIG. 4. The flanges extend outwardly from the drainage passage 26, as do the longitudinal guides 32, defining between them a receptacle 36 for receiving the pipe section 12 along the slots 18. The longitudinal guide 32 rests on the exterior surface of the pipe section 12, while the flanges 34 abut the interior surface of the pipe section 12.

Retaining the grate assembly 14 in place within the slots 18 of the pipe section 12 is a spacer 38. As best shown in FIG. 3, the spacer 38 comprises an elongated, flat bearing member including a plurality of spaced, serial water openings 40. The openings 40 are of size and spacing equal to the inlet apertures 30 of the grate assembly 14 so that, when the spacer 38 is inserted within the receptacle 36, the water openings 40 are in registration with the inlet apertures 30. Thus, any debris which flows through the inlet apertures 30 with inflowing drainage water will be more likely to flow through the water openings 40, falling into the pipe section 12 and being discharged with the drainage water.

Also, as illustrated in FIG. 3, one end 42 of the spacer 38 is tapered slightly to facilitate introduction of the spacer 38 into the longitudinal guide 32 formed in the sidewalls 24.

Figure 5:
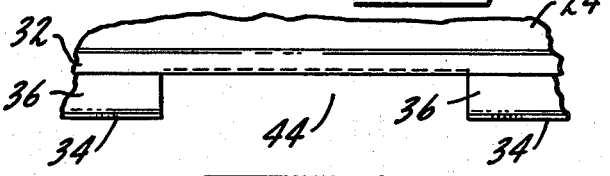
FIG. 5 is a partial plan illustration of the bottom of the grate means of the invention including a notch for accomodation of unslotted pipe portions.

To accommodate the unslotted portions 20, the grate assembly 14 must include notches 44 as illustrated in FIG. 5. The notches 44 are spaced in coincidence with the unslotted portions 20 and are dimensioned at least as large as the length of the unslotted portions 20 so that there is no interference between the grate assembly 14 and the slot 18 within the pipe section 12 during fabrication of the surface drainage culvert 10.

The surface drainage culvert 10 is fabricated in several steps. After the pipe section 12 is fabricated, such as by equipment described in U.S. Pat. No. 4,070,886, the slots 18 are cut into the pipe by a torch or with an appropriate saw, such as a friction saw. The grate assembly 14 is fabricated by roll forming, stamping or the like, either before cutting of the slots 18 or after, having the inlet apertures 30, sidewalls 24, longitudinal guides 32 and, preferably, flanges 34. Likewise, the spacer 38, having the water openings 40, is also fabricated. When the slotted pipe section 12, grate assembly 14 and spacer 38 are available, the surface drainage culvert is fabricated by squeezing the parallel sidewalls 24 of the grate assembly 14 slightly, and inserting the flanged end of the grate assembly within the slots 18. The grate assembly is then expanded so that the receptacles 36 engage the wall of the pipe section 12. Then, the spacer 38 is inserted longitudinally from one end of the surface drainage culvert. This last step locks the grate assembly in place within the pipe section 12 and maintains the parallel spacing of the sidewalls 24. Depending on the length of the fabricated surface drainage culvert 10, two spacers 38 may be utilized, one being inserted longitudinally from either end of the grate assembly 14.

Figure 7:
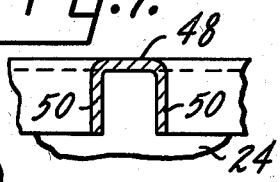
FIG. 7 is a cross-sectional illustration taken along lines 7—7 of FIG. 6.
Figure 6:
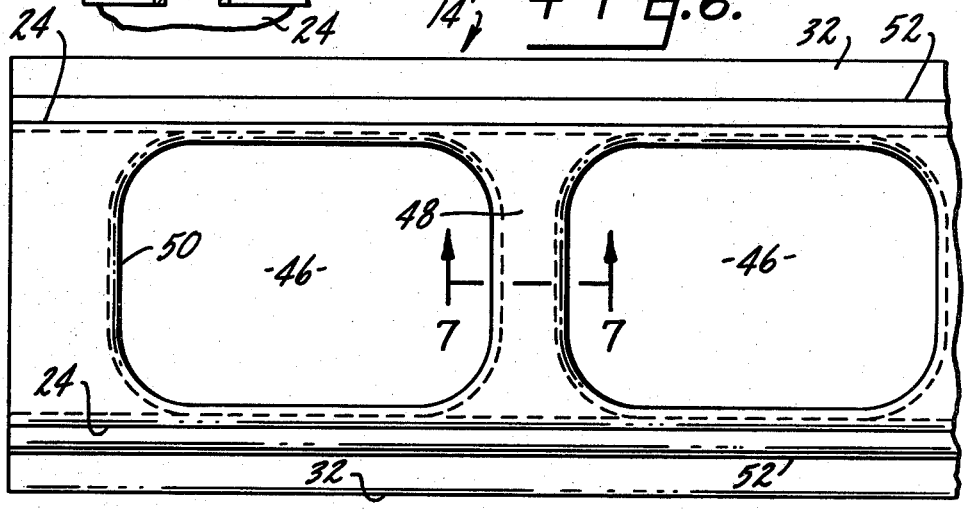
FIG. 6 is an enlarged partial top plan illustration of an alternative embodiment of the grate assembly.

FIGS. 6 and 7 illustrate an alternative embodiment of the grate assembly 14 of FIGS. 1 through 5. In this embodiment, only the inlet apertures of the grate assembly 14 are altered, and therefore all other elements of the grate assembly bear the same reference numerals and will not be discussed further.

The grate assembly 14' illustrated in FIG. 6 includes a plurality of inlet apertures 46 formed in the top thereof to allow ingress of drainage water. Between the inlet apertures 46, stiffeners 48 extend to maintain the structural integrity of the top of the grate assembly 14'.

As best illustrated in FIG. 7, to strengthen the top of the grate assembly 14', each of the inlet apertures 48 is formed with downwardly-depending flanges 50. As illustrated in phantom fashion in FIG. 6, the flanges 50 preferably extend about the entire periphery of the inlet apertures 46.

Depending on the height of the grate assembly 14, 14' to be used as part of a surface drainage culvert 10, one or more strengthening ribs or corrugations 52 may be fabricated longitudinally in the sidewalls 24 to help ensure that the sidewalls 24 remain straight and parallel.

Figure 8:
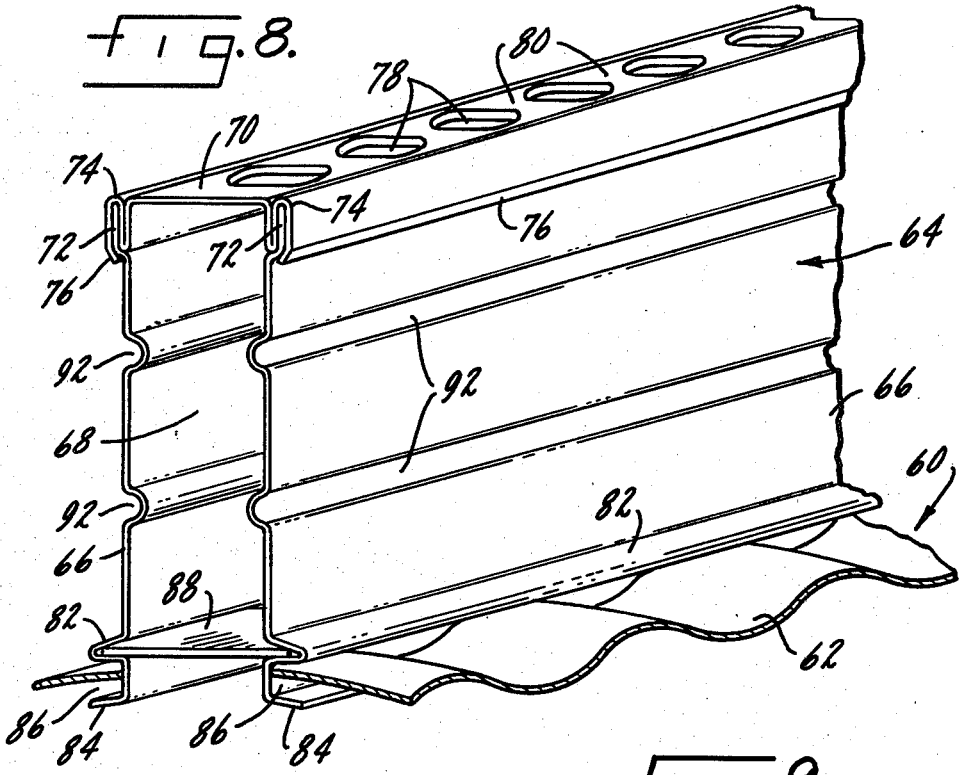
FIG. 8 is an enlarged, partial perspective illustration of another embodiment of the invention including a separate top plate.
Figure 9:
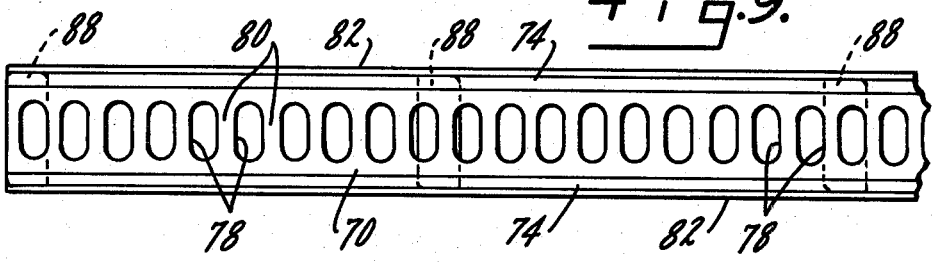
FIG. 9 is a top plan view of the invention with the pipe section omitted, showing location of the spacer means.
Figure 10:
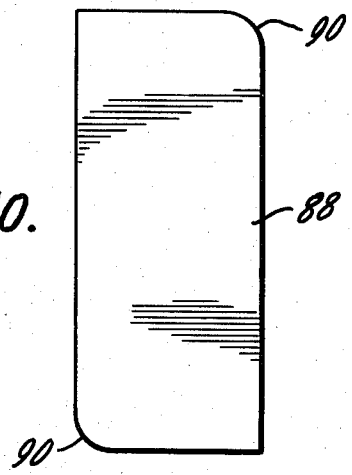
FIG. 10 is an enlarged plan view of a spacer.

FIGS. 8 through 10 illustrate another embodiment of the invention having a modified grate assembly and an alternative spacer means. As shown in FIG. 8, as in the previous embodiments, the culvert 60 is composed of a pipe section 62 and an upstanding, longitudinal grate assembly 64 received within a longitudinally cut aperture in the upper surface of the pipe section 62. The pipe section 62 may be fabricated in any conventional manner and can be helical or annular in cross-section. Although not illustrated in this embodiment, the aperture within the pipe section 62 is comprised of a series of spaced, longitudinal slots in the pipe with an unslotted pipe portion separating each such slot, as shown in greater detail in FIG. 1. As shown in FIG. 1, the slots can be situated such that any lock seam of the pipe section 62 remains inviolate and crosses the pipe aperture at the unslotted portions of the pipe.

The grate assembly 64 is comprised of a pair of spaced, parallel sidewalls 66 extending outwardly from the pipe above the slots. The spacing between the sidewall 66 forms an inlet drainage passage 68 which accepts drainage water inflow from the top of the passage and discharges drainage water into the interior of the pipe section 62 at the bottom of the passage 68, in exactly the same manner as the drainage passage 26 of the grate assembly 14 of the embodiment of the invention illustrated in FIGS. 1 through 7.

A top plate 70 is attached to the top edges of the sidewalls 66 to maintain the spacing of the sidewalls at the top of the drainage passage 68. As shown in FIG. 8, the tops of the sidewalls 66 include an outwardly protruding longitudinal step 72. Each marginal edge of the top plate 70 is formed with an S-shaped channel 74 which engages the corresponding step 72 and is locked to the sidewall 66 by means of an inwardly-turned peripheral flange 76.

The top plate 70 includes a series of inlet apertures 78. Bridges of metal extend laterally between the apertures 78, defining a series of lateral stiffeners 80 which maintain the spacing of the top of the grate assembly 64.

As in the grate assembly 14 of FIGS. 1 through 4, the grate assembly 64 includes a longitudinal guide 82 formed in each of the sidewalls 66 in proximity to the bottom of the drainage passage 68. Each of the sidewalls 66 also includes a flange 84 at the bottom of the drainage passage 68 extending outwardly from the drainage passage defining a receptacle 86 between the flange 84 and guide 82 for receiving the pipe section.

A series of spacers 88 retain the grate assembly 64 in place within the slot of the pipe section 62. As best shown in FIGS. 8 and 9, the spacers 88 are situated within the longitudinal guides 82. The spacers 88 are located periodically along the length of the grate assembly 64 as required to maintain the spacing of the grate assembly at the bottom of the drainage passage 68. Preferably, a spacer is located at each end of the grate assembly, at each crossing of the helical lock seam across the aperture (FIG. 1), and midway therebetween. As shown in FIG. 10, each of the spacers 88 is generally rectangular and has opposite rounded corners 90 to facilitate insertion within the longitudinal guide 82 as described in greater detail below. The number of spacers can be increased or decreased as required.

As the grate assemblies 14 and 14' of the embodiments of FIGS. 1 through 7, the grate assembly 64 may include one or more strengthening ribs or corrugations 92 fabricated longitudinally in the sidewalls 66 to strengthen the sidewalls. As shown, the ribs 92 may be protruding into the drainage passage 68 or, as described above, may protrude outwardly from the sidewalls.

The surface drainage culvert 60 is fabricated in several steps, many of which are identical to those utilized to fabricate the surface drainage culvert 10 described above. After the pipe section 12 is fabricated, a series of longitudinal slots are cut into the pipe in the same manner as described above. The grate assembly 64 is fabricated by roll-forming, stamping or the like in three parts, the two sidewalls 66 and the top plate 70. The inlet apertures 78 are normally fabricated during the formation process for the top plate 70. The sidewalls 66 are preferably fabricated having the longitudinal guide 82 and flange 84 defining the receptacle 86, one or more ribs 92, and the longitudinal step 72. Likewise, the spacers 88 are also fabricated prior to assembly of the surface drainage culvert 60.

When the slotted pipe section 62, grate assembly 64 and spacer 88 are available, the surface drainage culvert is fabricated by inserting the two sidewalls 66 into the slots in the pipe section 12. The spacers 88 are then inserted, being located with their longer dimension longitudinally of the guides 82, and then being rotated 90 degrees with the rounded corners 90 entering the guides 82 first and facilitating the 90 degree rotation of the spacers 88. This step locks the grate assembly 64 in place within the pipe section 62 and maintains the spacing of the sidewalls 66 at the pipe section 62. Finally, the top plate 70 is positioned upon the tops of the sidewalls 66 and locked into place with the flanges 76 secured beneath the steps 72. By virture of the nature of the top plate 70, the flanges 76 need not be squeezed to lock the top plate 70 to the sidewalls 66, but rather a snap lock fitting occurs due to the resilient nature of the metal of the top plate 70. Therefore, the top plate 70 can be placed upon the sidewalls 66 and then pushed or pounded into locking engagement as shown in FIG. 8.

ACHIEVEMENTS

The structure of the surface drainage culvert 10 and 60 of the present invention provides a unique, improved drainage device superior to the prior art.

By fabricating the slots 18 periodically along the upper surface of the pipe section 12, the unslotted portions 20 remain to absorb ring compression of the drainage culvert 10 when in use. In addition, by maintaining the slot spacing such that the lock seam 22 crosses at the unslotted portions 20, a critical portion of the pipe, the lock seam, is retained to enhance the strength of the pipe.

The spacers 38 (and 88) "replace" metal which is removed when the pipe section 12 (or 62) is slotted. The spacer is sufficiently close to the neutral axis of the pipe to maintain the pipe integrity in combination with the sidewalls of the grate assemblies. Also, the spacers ensure that the sidewalls of the grate assembly 14 and 64 are spread and firmly engage the pipe sections. The spacers lock the grate assemblies 14 and 64 in place.

Since the grate assemblies 14 and 64 can be prefabricated and therefore protected from the elements such as by galvanizing, when installed within a pipe section, the protection of the grate assembly is not compromized. There are no welds to affix the grate assemblies 14 or 64 to the pipe sections, and therefore no weak points for later deterioration.

If the grate assembly is galvanized and formed of a light enough gauge material, when the inlet apertures 30 are fabricated, such as by stamping, the edges of the inlet apertures are self-healing. This is true for coated metals of thickness to 10 or 8 gauge. Additionally, since no welding is necessary, precoated steels, such as polyvinyl chloride coated steel, can be used to resist the corrosive activity of ground water in saline areas.

Since the inlet apertures 30, 46 and 78 may be smaller in width than the width of the inlet drainage passages 26 and 68, clogging of the grate assembly can be avoided because material small enough to pass through the inlet apertures will normally not lodge within the inlet drainage passages and will tend to flow into the interior of the pipe sections 12.

The corrugations 52 or 92 on the upright sidewalls 24 strengthen the grate assemblies to help ensure their straightness. Also, the corrugations help to deflect loading on the top of the grate assemblies to surrounding backfill or roadway material when the surface drainage culvert 10 or 60 is installed. Finally, the corrugations help stiffen the grate assembly during placement of the surface drainage culvert so that dense materials, such as asphalt or concrete, do not tend to collapse the grate assembly.

The longitudinal guides 32 and 82, in addition to providing a guide way for the spacers 38 and 88, also act as beams which tend to transmit loading of the grate assemblies to the unslotted portions of the pipe sections. This adds to the load capability of the surface drainage culvert.

Finally, the grate assemblies are nestable. Since the surface drainage culvert need not be shipped in an assembled fashion, nesting of the grate assemblies 10 saves considerable shipping space.

Various changes may be made to the invention without departing from the spirit thereof or scope of the following claims.

What is claimed is:

1. In a surface drainage culvert comprising a pipe section which is cut longitudinally forming an aperture along its upper surface and having an upstanding, longitudinal grate assembly received within the aperture, the improvement comprising a. the aperture consisting of a plurality of longitudinally spaced slots in the pipe with unslotted pipe portions separating each said slot, b. said grate assembly consisting of i. a pair of spaced, parallel sidewalls extending outwardly from the pipe above said aperture, said sidewalls forming therebetween an inlet drainage passage which accepts drainage water inflow at the top of the passage and discharges drainage water through said aperture into the pipe section at the bottom of the passage, ii. stiffener means at the top of said drainage passage extending between said sidewalls to maintain the spacing of said sidewalls at the top of said drainage passage, and iii. a longitudinal guide formed in said sidewalls adjacent the bottom of said drainage passage, and c. spacer means situate in said guide to maintain the spacing of said sidewalls at the bottom of said drainage passage.

2. A drainage culvert according to claim 1 in which the pipe section includes a helical seam, and said slots are spaced such that said seam remains inviolate along the length of the pipe section.

3. A drainage culvert according to claim 2 in which said seam extends across the aperture at said unslotted pipe portions.

4. A drainage culvert according to claim 1 in which said stiffener means comprises a plurality of spaced bridges extending laterally between said sidewalls.

5. A drainage culvert according to claim 4 in which said bridges comprise integral extensions of said sidewalls.

6. A drainage culvert according to claim 1 in which said stiffener means comprises a longitudinal top plate attached to said sidewalls at the top of said drainage passage, said top plate including a plurality of spaced bridges extending laterally between said sidewalls.

7. A drainage culvert according to claim 1 in which said longitudinal guide comprises a channel in each said sidewall, said channels being oppositely situate in said grate assembly and extending outwardly from said drainage passage.

8. A drainage culvert according to claim 7 including a flange on each sidewall at the bottom of said drainage passage and extending outwardly from said drainage passage, said channel and said flange of each sidewall defining therebetween a receptacle for receiving the pipe section along said aperture and, in combination with said spacer means, comprising means to lock said grate assembly within said aperture.

9. A drainage culvert according to claim 1 in which said spacer means comprises at least one elongate bearing member, said bearing member including a water opening for passage therethrough of drainage water.

10. A drainage culvert according to claim 9 in which said water opening comprises a plurality of spaced serial apertures in said bearing member.

11. A drainage culvert according to claim 1 in which said spacer means comprises a plurality of spreader plates spaced periodically along the length of said guide.

12. A drainage culvert according to claim 11 in which said spreader plates are situated in said guide at said unslotted pipe portions.

13. A drainage culvert according to claim 1 in which said grate assembly includes a notch in each sidewall at the bottom of said drainage passage spaced in coincidence with and to accommodate said unslotted pipe portions.

14. A drainage culvert according to claim 1 in which each said sidewall includes longitudinal stiffening means to strengthen said grate assembly.

15. A drainage culvert according to claim 14 in which said longitudinal stiffening means comprises at least one rib extending outwardly from said drainage passage and spanning essentially the length of said grate assembly.

16. A grate assembly for a drainage culvert which consists of a pipe section which is cut longitudinally forming an aperture in the pipe section along its upper surface and which has the grate assembly lodged in the aperture, the grate assembly having a. a pair of spaced elongate parallel sidewalls forming therebetween a longitudinal inlet drainage passage for inflow of drainage water through one side of the grate assembly and discharge of drainage water through the other side of the grate assembly, b. a stiffener means at one side of said grate assembly extending between said sidewalls to maintain the spacing of said sidewalls at said one side, c. a longitudinal guide formed in said sidewalls adjacent said other side, and d. removable spacer means situate in said guide to maintain the spacing of said sidewalls at said other side.

17. A grate assembly according to claim 16 in which said stiffener means comprises a plurality of spaced bridges extending laterally between said sidewalls.

18. A grate assembly according to claim 17 in which said bridges comprise integral extensions of said sidewalls.

19. A grate assembly according to claim 16 in which said stiffener means comprises a longitudinal top plate attached to said sidewalls at said one side of said grate, said top plate including a plurality of spaced bridges extending laterally between said sidewalls.

20. A grate assembly according to claim 16 in which said longitudinal guide comprises a channel in each said sidewall, said channels being oppositely situate in said grate assembly and extending outwardly from said drainage passage.

21. A grate assembly according to claim 16 in which said spacer means comprises at least one elongate bearing member, said bearing member including a water opening for passage therethrough of drainage water.

22. A grate assembly according to claim 16 in which said spacer means comprises a plurality of spreader plates spaced periodically along the length of said guide.

23. A grate assembly according to claim 16 in which each said sidewall includes longitudinal stiffening means to strengthen said grate assembly.

24. A grate assembly according to claim 23 in which said longitudinal stiffening means comprises at least one rib extending outwardly from said drainage passage and spanning essentially the length of said grate assembly.

* * * * *